United States Patent [19]

Morgan

[11] 3,989,016

[45] Nov. 2, 1976

[54] MECHANICAL VALVE LIFTER

[75] Inventor: Robert E. Morgan, Grand Rapids, Mich.

[73] Assignee: General Motors Corporation, Detroit, Mich.

[22] Filed: July 25, 1975

[21] Appl. No.: 598,744

[52] U.S. Cl. ..... 123/90.16; 74/569; 123/90.52

[51] Int. Cl.[2] ..... F01L 1/14

[58] Field of Search..... 123/90.16, 90.52, 90.48; 74/569

[56] References Cited

UNITED STATES PATENTS

| | | | |
|---|---|---|---|
| 1,403,682 | 1/1922 | Gorton | 123/90.52 |
| 1,440,427 | 1/1923 | Wigelius | 123/90.16 |
| 3,002,508 | 10/1961 | Barker | 123/90.52 |
| 3,270,726 | 9/1966 | Cotton | 123/90.52 |
| 3,369,532 | 2/1968 | McIlroy | 123/90.16 |

*Primary Examiner*—Charles J. Myhre
*Assistant Examiner*—Daniel J. O'Connor
*Attorney, Agent, or Firm*—Arthur N. Krein

[57] ABSTRACT

A mechanical valve lifter including a cup member adapted to fit over the end of a valve stem, the cup member having a boss therein with an axial bore extending from one end thereof and a threaded bore extending radially from the exterior of the cup member to intersect the bore in the boss, an elastomer plug positioned in the bore of the boss, a piston member slidably received in the bore with one side thereof in abutment with the elastomer plug and the other side engageable with the end of the valve stem and, an internal wrenching head screw threaded into the threaded bore to engage the elastomer plug.

3 Claims, 3 Drawing Figures

MECHANICAL VALVE LIFTER

This invention relates to valve lifters or tappets for transmitting movement from a cam or the like to the stem of a poppet valve, such as is used in internal combustion engines and, in particular, to a mechanical valve lifter.

Various mechanical tappets or valve lifters, hereinafter referred to as valve lifters, have been used in the prior are which were provided with adjusting means, such as adjustable bolts or shims, so that the opening and closing of each individual valve of an engine could be separately adjusted. Such mechanical valve lifters are interposed between the valve actuating cam and the end of the valve stem.

One such mechanical valve lifter, presently in use, is of the type disclosed in U.S. Pat. No. 3,270,726 issued Sept. 6, 1966 to John Lee Cotton and comprises a cup-shaped member which is adapted to fit over the end of the valve stem, the member having a transverse threaded bore containing and ajustable screw plug with a tapered flat surface thereon for contacting the end of the valve stem. Although a valve lifter of this type provides satisfactory performance, it is relatively expensive to manufacture.

It is therefore the primary object of this invention to provide an improved mechanical valve lifter which is simple in construction and which includes a piston chamber in the lifter body having a piston member and an elastomer plug therein, the piston chamber also having a threaded bore in communication therewith to receive a set screw in threaded engagement therewith for adjustable positioning within the piston chamber in contact with the elastomer plug whereby to adjust the effective height of the valve lifter.

Another object of this invention is to provide an improved valve lifter having an elastomer plug and set screw in engagement with the plug to permit adjustment of the effective height of the valve lifter.

These and other objects of the invention are obtained by means of a valve lifter comprising a cup member having a base and an integral depending annular wall, the base having an exterior cam engaging surface on one side thereof and a depending boss on the other side thereof extending axially within the annular wall, the base having a cylindrical bore therein concentric with the annular wall and extending axially inward from the free end of the boss, the cup member further having a radial extending threaded bore therein intersecting the bore in the boss, an elastomer plug being positioned in the bore and a piston member is slidably received in the bore with one end thereof abutting the elastomer plug and the other end positioned to engage the end of the valve stem over which the cup member is positioned and, an internal wrenching head set screw is threaded into the threaded bore and positioned axially therein to adjustably engage the elastomer plug within the bore of the boss.

For a better understanding of the invention, as well as other objects and further features thereof, reference is had to the following detailed description of the invention to be read in connection with the accompanying drawings, wherein.

Figure 1:
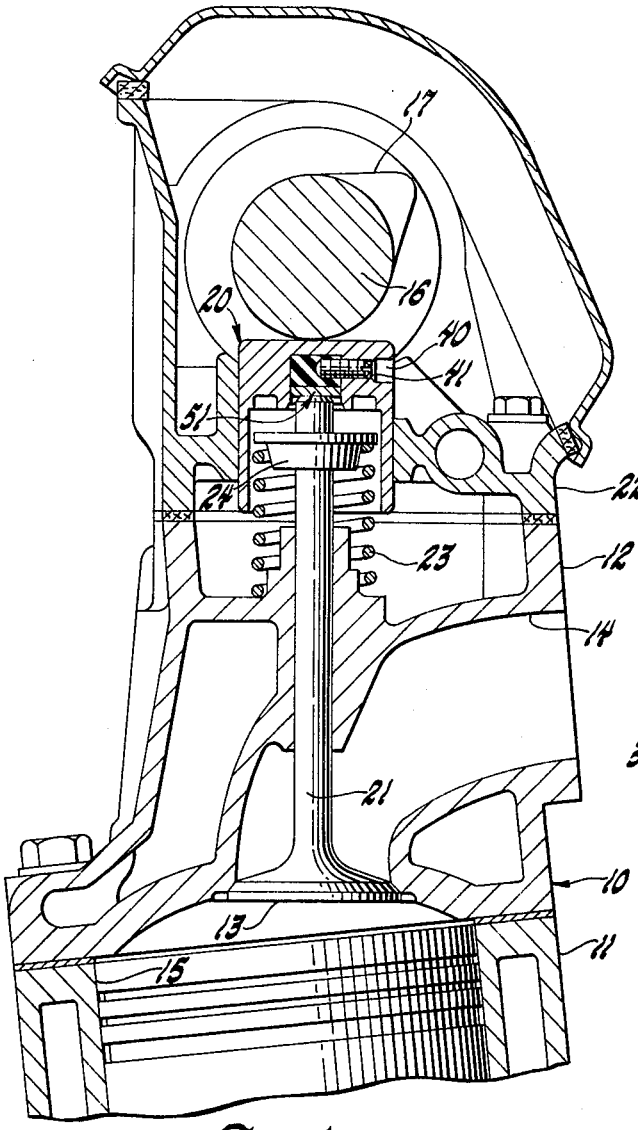
FIG. 1 is a vertical cross section of the upper part of a cylinder of an internal combustion engine provided with a mechanical valve lifter in accordance with the invention.

Referring now to FIG. 1, there is shown parts of an internal combustion engine 10, including a cylinder block 11, on which is mounted a cylinder head 12, fitted with a conventional poppet valve 13, for controlling a port 14, connecting the engine cylinder 15 with the engine manifold (not shown).

A rotatable camshaft 16 has a cam lobe 17 which bears against a valve lifter 20, constructed in accordance with the invention, fitted over the end of the valve stem 21 of valve 13 and reciprocally mounted in camshaft block 22 to effect opening of valve 13 against the biasing force of a coiled return spring 23 bearing upwardly from the cylinder head 12 against a spring retainer 24 locked, in a well known manner, to the valve stem 21. The camshaft 16 is driven from the engine crankshaft in the conventional manner.

The valve lifter 20, in accordance with the invention, includes a lifter body 31 formed as a cup-shaped member having a base 32 with an integral depending annular wall 33. Base 32 has an outer or upper surface 34, with reference to the drawings, adapted to be contacted by the cam lobe 17 and a depending axially extending boss 35, spaced radially inward from the depending annular wall 33.

The base 32 is provided with a cylindrical body cavity or bore, open to the bottom of the lifter body and of a predetermined diameter formed concentric with annular wall 33, that extends from the free end of boss 35 a predetermined axial distance into base 32 to provide a body cavity defined by an inner peripheral wall 36 and an end wall 37, the wall 36 being of a suitable diameter so as to freely receive the free end of the valve stem 21. The lifter body 31 is also provided with a stepped bore or crossbore 40, that includes an internally threaded bore 41 portion, axially positioned so that it extends from the outer peripheral surface of the lifter body 31 radially inward to have the threaded bore 41 run out at the inner annular wall 36 closely adjacent to the end wall 37.

The body cavity, defined by the inner peripheral wall 36 and end wall 37, receives therein an elastomer plug 50 for abutment against end wall 37 and a piston 51 positioned to extend beneath the elastomer plug, the piston 51 being slidably received in the body cavity to close off the lower end of the body cavity with the one end or outboard end 52 of the piston 51 thus positioned to be engaged by the free end of valve stem 21.

Figure 3:
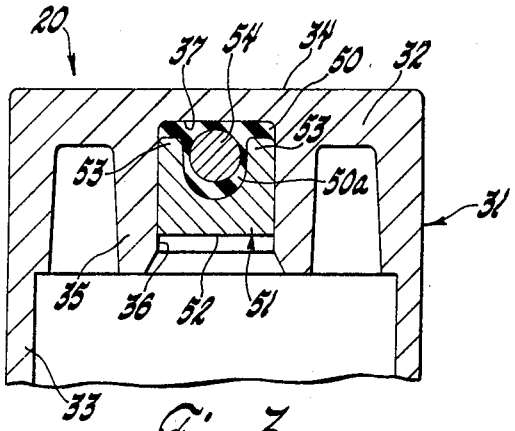

The elastomer plug 50, made of a suitable material, such as rubber, and the piston 51 are preferably fastened together as by bonding, molding or, as shown, mechanically retained together as by means of suitably spaced apart knobs 53 extending axially upward from the top of the piston with the reduced end **50*a* of the plug 50 sandwiched therebetween, as shown in FIG. 3. The elastomer plug 50, in its free form, is formed with an outer peripheral surface having a diameter corresponding to the outside diameter of the piston 51**.

An internal wrenching head set screw, such as the hexagon socket set screw 54, with preferably an oval point **54*a* thereon, is threaded into the threaded bore 41 and into contact with the elastomer plug 50, within the body cavity, preferably so as to penetrate into the elastomer plug. In the embodiment shown, the knobs 53 of piston 51 are spaced sufficiently apart so as to loosely receive the set screw 54** therebetween as the set screw engages and penetrates the elastomer plug portion retained between these knobs.

Figure 2:
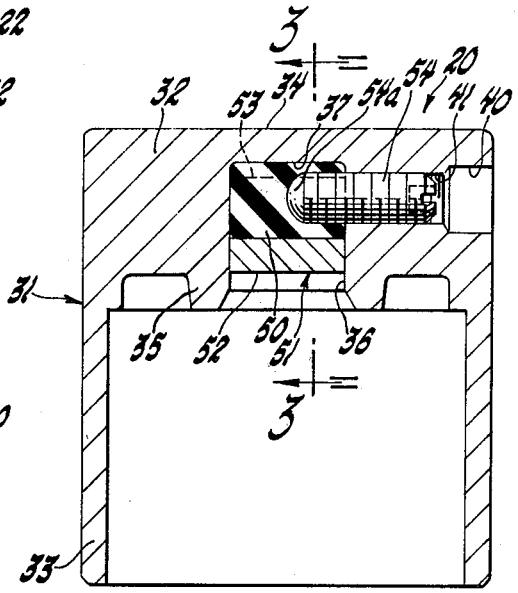
FIG. 2 is an enlarged vertical sectional view of the mechanical valve lifter of FIG. 1; and, FIG. 3 is a sectional view of the mechanical valve lifter taken along line 3—3 of FIG. 2.

With this arrangement, the effective height or axial length of the valve lifter, that is, the axial spacing between the upper surface 34 of the lifter body and the lower end 52 of piston 51, can be varied, as desired, by adjustment of the amount of penetration of the set screw 54 into the elastomer plug 50 whereby to vary the effective volume displaced by the elastomer plug within the body cavity between the end wall 37 and the top of piston 51. As can be seen with reference to FIG. 2, radial penetration of the screw 54 into or out of the elastomer plug will effect axial displacement of the elastomer plug within the body cavity and therefore the effective volume displaced by this elastomer plug within the body cavity with then corresponding axial displacement of the piston 51 within the cavity.

It should be realized that the effective volume of the cavity occupied by the elastomer plug can be controlled, as desired, by controlling the inside diameter of the cavity and by controlling the length of the plug between the top of the piston and the end wall 37 of the cavity, as desired. Therefore, it will be apparent that a set screw 54 of a predetermined pitch and of a predetermined pitch diameter will displace a definite predetermined volume of the elastomer plug 50 for each rotation for the set screw through one full revolution.

Preferably, the elastomer plug 50 should be formed of a suitable material, such as a soft butyl rubber material, preferably having a Durometer hardness No. 40 or lower whereby this material will be readily conductive to plastic flow within the cavity and to more readily fill any void in the cavity. However, it should be realized that, on the other hand, too soft an elastomer material would require that the inside diameter of the bore in the lifter body 31 and the outside diameter of the piston 51 must be machined so as to provide a very close clearance between these elements and, of course, a higher class fit must also be maintained between the set screw 54 and the threaded bore 41 so as to prevent extrusion of the softer elastomer material through these clearance spaces under high load conditions. It should also be realized that in view of the environment in which the elastomer plug is to be used, the elastomer material out of which the plug is fabricated should be of a suitable type adapted to withstand continued heat soaking at approximately 250° F.

It will be apparent that the larger the pitch diameter of the set screw 54, the greater the displaced volume of elastomer plug per revolution of the set screw for a particular thread pitch and, it will also be apparent that the greater the thread pitch or lead of the set screw, the greater the volume of the elastomer plug within the body cavity that will be displaced per turn of the set screw. It will also be apparent that the larger the diameter of the bore forming the body cavity in the lifter body, the less change will occur in the installed effective height of the valve lifter for a given displacement of the set screw 54. Stated in other words, the total range in the installed height of a particular valve lifter is a function of the diameter of the body cavity formed in the lifter body, the pitch diameter and lead of the set screw, and the number of turns the set screw is rotated within the threaded bore 41.

Ideally, the valve lifter 20 would have an effective height such that, when the valve lifter is installed in the engine with the cam lobe 17 on its base circle and the valve 13 seated in the cylinder head, there would be proper clearance or lash between the piston 51 and the top of the valve stem 21. If upon installation this proper clearance or lash is not obtained with the valve lifter as installed, it would then be necessary to effect adjustment of the set screw 54 by rotating it in or out, as necessary, to obtain the proper lash. It will be apparent that the maximum installed height of the valve lifter would occur when the oval point **54*a* of the set screw 54 contacts the opposite side of the annular wall 36 from the threaded bore 41 and, likewise, the minimum installed height obtainable would be when the piston 51 bottoms out in the body cavity against the end wall 37**.

However, it should be realized that, preferably, these extreme positions are avoided so that at all times there would be some penetration of the set screw 54 into the elastomer plug 50 for assurance that the set screw will be securely locked in place to prevent any rotation of the set screw during engine operation. Also, it will be readily apparent that the drive end of the set screw 54 must not extend beyond the outside diameter of the lifter body 31 at any time. It should also be realized that if the set screw is adjusted to the maximum position, there is the possibility, in a given valve lifter arrangement, that there may be too little thread engagement of the set screw 54 within the threaded bore 41.

What is claimed is:

1. A mechanical valve lifter including a cup member having a base and an integral depending annular wall adapted to seat over the end of a valve stem, said base having an exterior cam engaging surface on one side thereof and a boss on the other side thereof extending axially within said annular wall, said base having a cylindrical bore therein concentric with said annular wall and extending from said boss, said base further having a radial extending threaded bore therein intersecting said cylindrical bore, an elastomer plug positioned in said cylindrical bore, a piston member slidably received in said cylindrical bore in position to have one side thereof in abutment with said elastomer plug and to have the opposite side thereof contacted by the end of the valve stem and, an internal wrenching head set screw threaded into said threaded bore into engagement with said elastomer plug within said cylindrical bore.

2. A valve tappet comprising a cup member having a cylindrical recess therein adapted to fit over and enclose the end of a valve stem, said cup member having a radial threaded bore intersecting said cylindrical recess, an elastomer plug and a piston positioned in said cylindrical recess, said piston being slidably received in said cylindrical recess in position to engage the end of the valve stem and, an internal wrenching head set screw adjustably threaded into engagement into said threaded bore to engage and effect displacement of said elastomer plug within said cylindrical recess whereby the effective height of said valve tappet can be varied.

3. A valve lifter comprising a cup member having a base with a cylindrical recess therein terminating in an end wall within said base and an integral annular wall depending from said base, said cup member having a threaded bore extending from the outer periphery thereof to intersect said cylindrical recess, a set screw adjustably threaded into said threaded bore, an elastomer plug, and a piston secured to said elastomer plug, said elastomer plug and said piston being slidably positioned within said recess with said elastomer plug positioned to abut against said end wall and to be engaged by said set screw.

* * * * *